US008573290B2

(12) United States Patent
Blomgren

(10) Patent No.: US 8,573,290 B2
(45) Date of Patent: Nov. 5, 2013

(54) SPIRAL HEAT EXCHANGER

(75) Inventor: Ralf Blomgren, Skanör (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 13/581,747

(22) PCT Filed: Mar. 8, 2011

(86) PCT No.: PCT/EP2011/053428
§ 371 (c)(1),
(2), (4) Date: Aug. 29, 2012

(87) PCT Pub. No.: WO2011/110537
PCT Pub. Date: Sep. 15, 2011

(65) Prior Publication Data

US 2012/0325444 A1 Dec. 27, 2012

(30) Foreign Application Priority Data

Mar. 8, 2010 (EP) ..... 10155724

(51) Int. Cl.
*F28D 7/02* (2006.01)
*F28F 3/00* (2006.01)

(52) U.S. Cl.
USPC ..... 165/164; 165/165

(58) Field of Classification Search
USPC ..... 165/164, 165, 166, 167, 67
See application file for complete search history.

(56) References Cited

U.S. PATENT DOCUMENTS 2,236,976 A * 4/1941 Rosenblad ..... 29/890.03
2,267,619 A * 12/1941 Strom ..... 29/890.039
2,657,018 A * 10/1953 Simpelaar ..... 165/103
4,124,069 A 11/1978 Becker
4,655,174 A * 4/1987 Fillios ..... 122/261
2003/0102114 A1 6/2003 Gueguen
2004/0173341 A1 9/2004 Moser et al.
2009/0314479 A1* 12/2009 Oswald ..... 165/152
2012/0125583 A1 5/2012 Persson

FOREIGN PATENT DOCUMENTS

BE 428773 A 7/1938
CN 1667341 A 5/2005
CN 201397069 Y 2/2010
EP 0077009 A1 4/1983

(Continued)

OTHER PUBLICATIONS

English language translation of the First Office Action dated Apr. 16, 2012, issued by the Japanese Patent Office in corresponding Japanese Patent Application No. 2012-556480. (2 pages).

(Continued)

*Primary Examiner* — Tho V Duong

(74) *Attorney, Agent, or Firm* — Buchanan Ingersoll & Rooney PC

(57) ABSTRACT

A spiral heat exchanger includes a spiral body formed by at least one spiral sheet wound to form the spiral body forming at least a first spiral-shaped flow channel for a first medium and a second spiral-shaped flow channel for a second medium, wherein the spiral body is enclosed by a substantially cylindrical shell being provided with connecting elements communicating with the first flow channel and the second flow channel, where the at least one spiral sheet comprises a corrugated heat transfer surface with corrugations for increasing the heat transfer and supports for spacing the wounds of the at least one spiral sheet in the spiral body.

8 Claims, 10 Drawing Sheets

(56) References Cited

FOREIGN PATENT DOCUMENTS

| | | | | |
|---|---|---|---|---|
| EP | 1295077 | B1 | | 11/2003 |
| FR | 2809483 | A1 | | 11/2001 |
| GB | 2156961 | A | * | 10/1985 |
| JP | 53-128046 | A | | 11/1978 |
| JP | 6-273081 | A | | 9/1994 |
| JP | 07-019774 | A | | 1/1995 |
| JP | 11-248377 | A | | 9/1999 |
| JP | 2002-195771 | A | | 7/2002 |
| JP | 2003-535303 | A | | 11/2003 |
| JP | 2006-522311 | A | | 9/2006 |
| JP | 2009-014220 | A | | 1/2009 |
| JP | 2012-112645 | A | | 6/2012 |
| SU | 898255 | A1 | | 1/1982 |

OTHER PUBLICATIONS

International Search Report (PCT/ISA/210) issued on Nov. 29, 2011, by the European Patent Office as the International Searching Authority for International Application No. PCT/EP2011/053428.

* cited by examiner

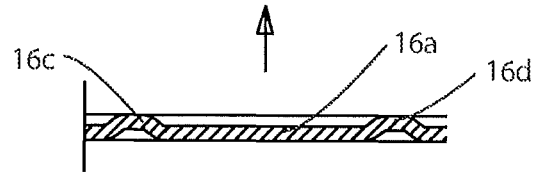
Fig. 7b
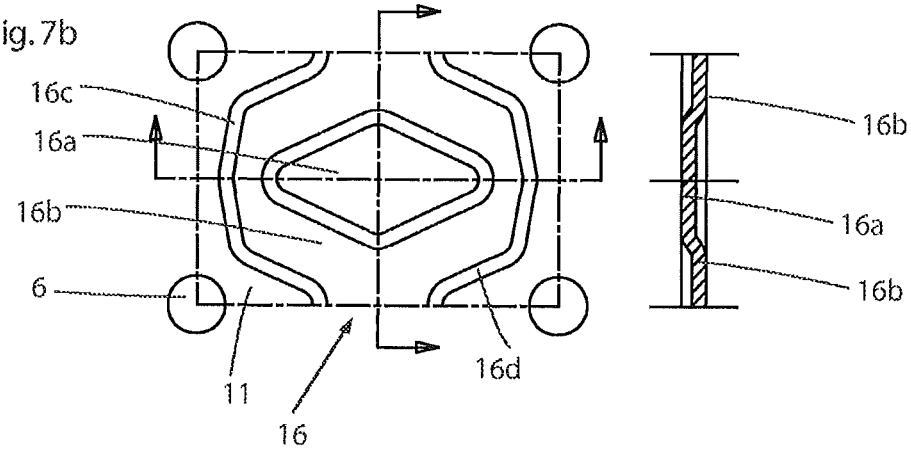
Fig. 7a
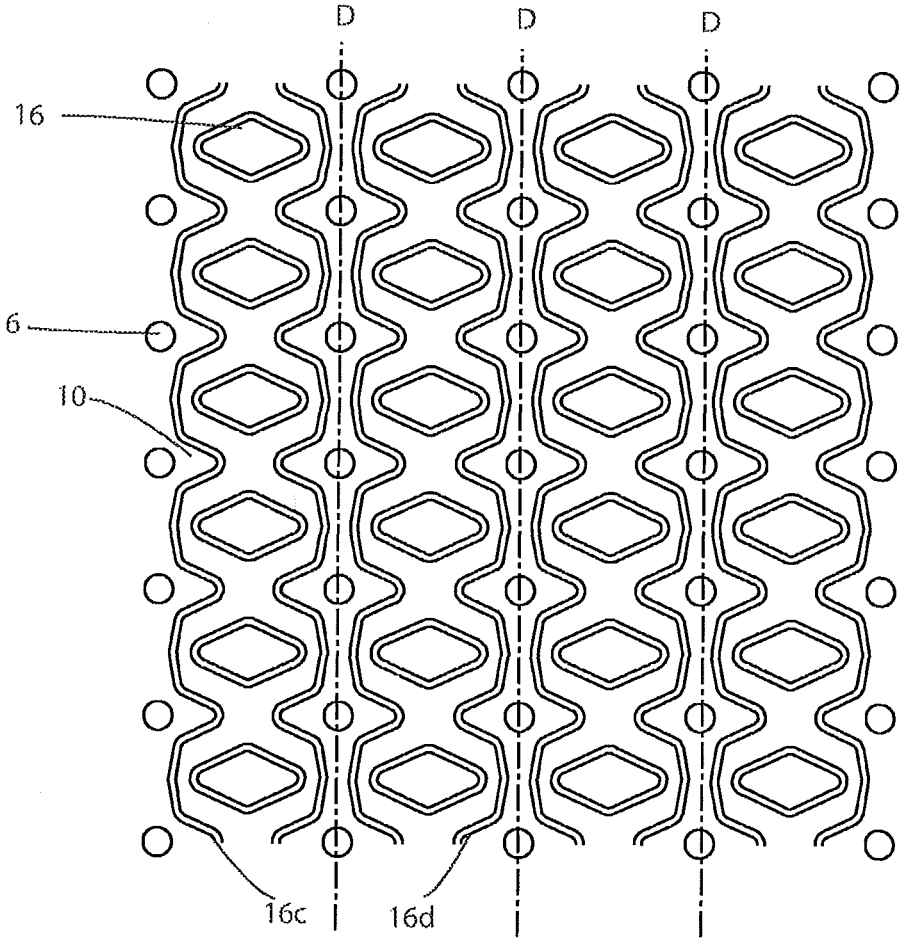

SPIRAL HEAT EXCHANGER

The present invention refers generally to spiral heat exchangers allowing a heat transfer between two fluids at different temperature for various purposes. Specifically, the invention relates to a spiral heat exchanger having a corrugated heat transfer surface.

BACKGROUND OF INVENTION

Conventionally, spiral heat exchangers are manufactured by means of a winding operation. The two flat sheets are welded together at a respective end, wherein the welded joint will be comprised in a center portion of the sheets. The two sheets are wound around one another to form the spiral element of the sheets so as to delimit two separate passages or flow channels. Distance members, having a height corresponding to the width of the flow channels, are attached to the sheets.

Two inlet/outlet channels are formed in the center of the spiral element. The two channels are separated from each other by the center portion of the sheets. A shell is welded onto the outer periphery of the spiral element. The side ends of the spiral element are processed, wherein the spiral flow channels may be laterally closed at the two side ends in various ways. Typically, a cover is attached to each of the ends. The covers may include connection pipes extending into the center and communicating with a respective one of the two flow channels. At the radial outer ends of the spiral flow channels a respective header is welded to the shell or the spiral element forming an outlet/inlet member to the respective flow channel.

To improve the heat transfer between the fluids in the spiral heat exchanger, which heat transfer surface traditionally is formed by a wound flat plate, attempts have been made to use corrugated sheets similar to those used in plate heat exchangers.

In the European patent document EP-B1-1 295 077 a spiral exchanger is shown, consisting of two overlapping fluid circuits, a first circuit formed by the space included between two spaced sheets wound on themselves and a circuit formed by the space included between the successive turns of said winding. The sheets comprise, on their opposite surfaces, spacing elements, said spacing elements being arranged along the longitudinal axis of the sheets, so that, once the sheets are wound, the spacing elements of a sheet are urged to be pressed on the corresponding spacing elements of the other sheet, the end surface of at least one of the two pressed spacing elements is globally planar. The spacing elements and the corrugations are formed from the sheet.

In the Chinese patent application CN1667341 a spiral corrugated plate heat exchanger is disclosed having sheets provided with a corrugated surface. The height of the peak valley of the corrugated surface determines the width of two fluid channels.

In the Japanese patent document JP-A-6273081 a spiral heat exchanger is disclosed, the spiral heat exchanger is formed by winding a heat transfer plate, which comprises stud pins as spacers at a one-way channel, and disturbance bars at the other channel. The bars are intermittently arranged in a zigzag manner, and mounted at an angle to extend in an advancing direction of fluid. Accordingly, since the intermittent bars are arranged in the zigzag manner, the fluid is dispersed and mixed to improve heat transfer performance.

In the Russian patent document SU898255 a heat exchanger is disclosed having corrugated sheets twisted in spirals and having spacing pins arranged between the sheets to absorb force loads.

None of the above suggested attempts to improve the heat transfer of a spiral heat exchanger fully succeeds in providing a good solution, since they are either too complicated in their construction or merely tries to copy features of plate heat exchangers into the spiral heat exchangers without adapting them to the characteristics of the spiral heat exchanger.

DISCLOSURE OF INVENTION

The object of the present invention is to overcome the problems mentioned above with the prior art spiral heat exchangers. More specifically, it is aimed at a spiral heat exchanger in which the heat transfer surface is provided with a corrugated pattern to improve the heat transfer and with abutting supports which are arranged inside in the corrugated heat transfer surface.

This object is achieved by a spiral heat exchanger including a spiral body formed by at least one spiral sheet wounded to form the spiral body forming at least a first spiral-shaped flow channel for a first medium and a second spiral-shaped flow channel for a second medium, wherein the spiral body is enclosed by a substantially cylindrical shell being provided with connecting elements communicating with the first flow channel and the second flow channel and where the at least one spiral sheet comprises a corrugated heat transfer surface for increasing the heat transfer and supports for spacing the wounds of the at least one spiral sheet in the spiral body.

According a further aspect of the invention the supports are provided on tangential paths on the at one least spiral sheet between the corrugations and where the tangential paths between the corrugations are a substantially evenly curved surfaces.

According another further aspect of the invention the supports are welded studs for spacing the wounds of the at least one spiral sheet in the spiral body.

According a still further aspect of the invention the main extensions of corrugations are inclined with an angle relative a longitudinal direction parallel to the tangential paths of the supports.

According a yet further aspect of the invention and where the corrugated heat transfer surface includes at least one type of the corrugations, and in specific solution includes two types of corrugations and where the two types of corrugations together forms a mirror shaped corrugation pattern relative to the tangential paths of supports.

According a yet further aspect of the invention the corrugated heat transfer surface includes different corrugated surfaces within the corrugations or/and where the different corrugated surfaces with the corrugations have different pressing depth.

According a still further aspect of the invention the relative spacing between the supports along a longitudinal direction and between the corrugations along a longitudinal direction parallel to the longitudinal direction are substantially the same or where the relative spacing between the supports a longitudinal direction and between the corrugations and between the corrugations along a longitudinal direction parallel to the longitudinal direction are substantially different.

Another object of the present invention is to provide a spiral heat exchanger having improved heat transfer characteristics and improved mechanical strength.

This object is achieved by a spiral heat exchanger having supports provided along a tangential centre line of the corrugated pattern fields. The supports are studs welded onto the corrugated pattern fields, and where the free end of the supports abuts on tangential paths of the at least one spiral sheet between the corrugated pattern fields. One support can be welded onto each corrugated pattern field.

Further aspects of the invention are apparent from the dependent claims and the description.

A spiral heat exchanger with a heat transfer surface provided with corrugations or corrugated pattern fields gives improved strength and improved heat transfer compared with the traditional flat heat transfer surface of a spiral heat exchanger. The actual heat transfer surface becomes also larger compared with a conventional spiral heat exchanger of the same size.

BRIEF DESCRIPTION OF THE DRAWINGS

Further objects, features and advantages will appear from the following detailed description of several embodiments of the invention with reference to the drawings, in which:

FIGS. 3*a*-10*b* are schematic views of several different corrugation patterns of a spiral heat exchanger according to a second embodiment of the present invention.

DETAILED DESCRIPTION OF EMBODIMENTS

A spiral heat exchanger 1 includes at least one spiral sheet extending along a respective spiral-shaped path around a common centre axis and forming at least two spiral-shaped flow channels 20*a*, 20*b*, which flow channels 20*a*, 20*b* are substantially parallel to each other. Each flow channel includes a radially outer orifice, which enables communication between the respective flow channel and a respective outlet/inlet conduit and which is located at a radially outer part of the respective flow channel with respect to the centre axis, and a radially inner orifice, which enables communication between the respective flow channel and a respective inlet/outlet chamber, so that each flow channel permits a heat exchange fluid to flow in a substantially tangential direction with respect to the centre axis. The centre axis extends through the inlet/outlet chambers at the radially inner orifice. Distance members (not shown in FIG. 1), having a height corresponding to the width of the flow channels 20*a*, and 20*b*, can be attached to the sheets or be formed on the surface of the sheets. The distance members or studs support the spiral body formed by the at least one spiral sheets and the inner surface of the shell to resist the pressure of the working fluids of the spiral heat exchanger 1.

Figure 1:
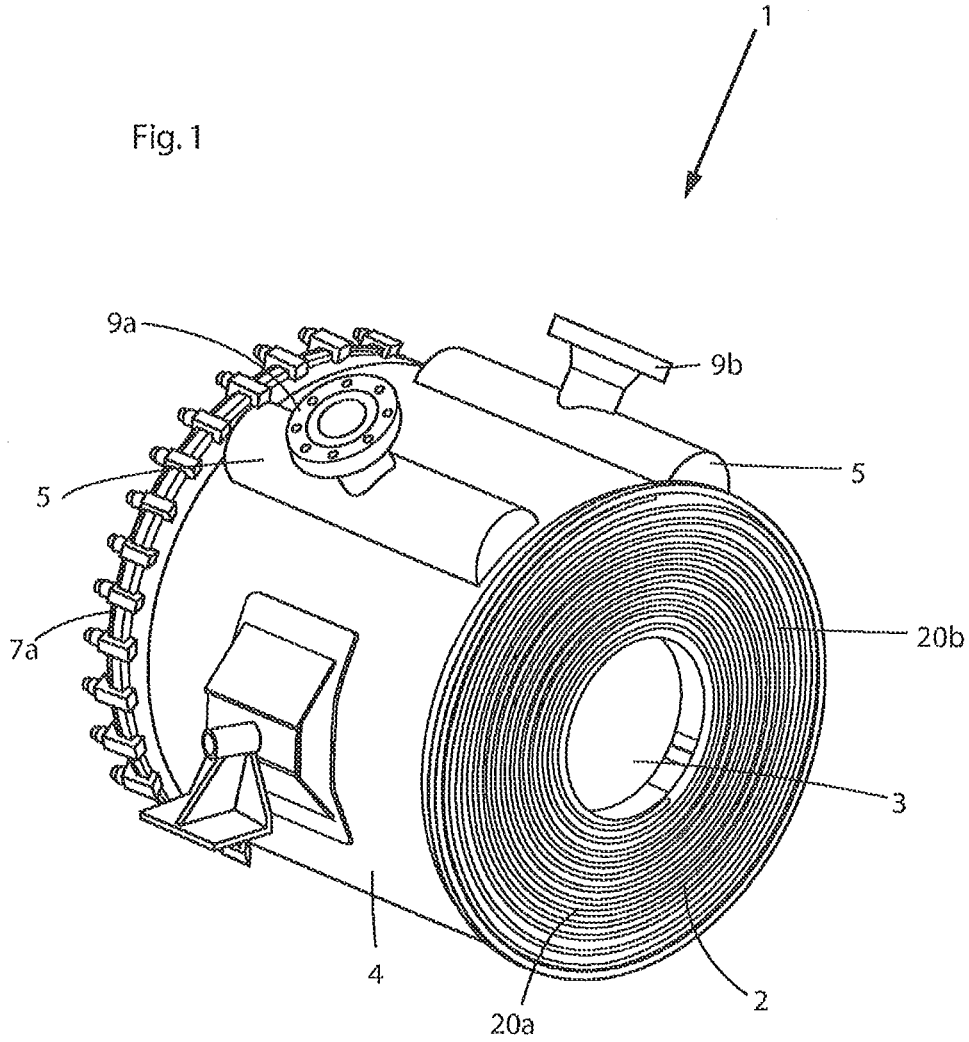
FIG. 1 is a perspective view of an open spiral heat exchanger according to the present invention.

In FIG. 1 is shown a perspective view of a spiral heat exchanger 1 according to the present invention. The spiral heat exchanger 1 includes a spiral body 2, formed in a conventional way by winding two sheets of metal around a retractable mandrel. The sheets are provided with distance member or supports 6 (not shown in FIG. 1) attached to the sheets. The distance members or supports 6 serve to form the flow channels 20*a*, 20*b* between the sheets and have a length corresponding to the width of the flow channels 20*a*, 20*b*. In FIG. 1 the spiral body 2 only has been schematically shown with a number of wounds, but it is obvious that it may include further wounds and that the wounds are formed from the centre of the spiral body 2 all the way out to the peripheral of the spiral body 2. The spiral body 2 is enclosed by a shell 4.

The shell 4 is formed as a cylinder having open ends, the open ends being provided with a flange. Lids or covers 7*a*, 7*b* are provided to close the shell 4 in each end. Connection elements 9*a*, 9*b* are attached to the outer surface of the shell 4. The lids or covers 7*a*, 7*b* are provided with connection elements 8*a*, 8*b*. The connection elements 8*a*-*b* and 9*a*-9*b* are typically welded to the shell 4 and the covers 7*a*, 7*b*, and are all provided with a flange for connecting the spiral heat exchanger 1 to a piping arrangement of the system of which the spiral heat exchanger 1 is a part of. Other configurations of the connection elements are also possible.

The spiral heat exchanger 1 is further provided with gaskets, each gasket being arranged between the open ends of the shell, the spiral body 2 and the lids or cover 7*a*, 7*b*. The gaskets serves to seal off the different wounds of the flow channels 20*a* or 20*b* from each other to prevent that a medium in the flow channels to bypass wounds of flow channels 20*a* or 20*b* and lowering the thermal exchange. The gaskets, which can be formed as a spiral similar to the spiral of the spiral body 2, is then squeezed onto each wound of the spiral body 2. Alternatively the gaskets are squeezed between the spiral body 2 and the lids or covers. The gaskets can also be configured in other ways as long as the sealing effect is achieved.

Figure 2:
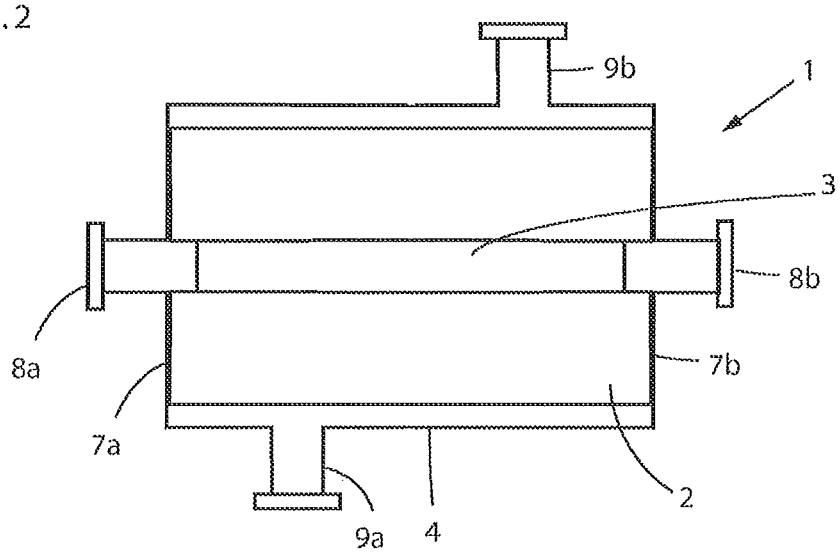
FIG. 2 is a schematic cross sectional view of a spiral heat exchanger according to the present invention.

FIG. 2 shows a schematic cross section of the spiral heat exchanger 1 of FIG. 1 having a spiral body 2, connections 8*a*, 8*b* provided on the covers 7*a*, 7*b* of the spiral heat exchanger 1 and connected to the flow channels 20*a*, 20*b*, respectively, at the centre of the spiral body 2, and connections 9*a*, 9*b* provided on the outer of the shell 4 of the spiral heat exchanger 1 and connected to the flow channels 20*a*, 20*b*, respectively.

In FIGS. 3-10 are shown different variants of corrugated heat transfer surfaces 10, where the corrugations have no support function, but where the support function is provided by welded supports or studs 6. The heat transfer surface 10 are provided with corrugations and welded support studs 6, where the corrugations are arranged between tangential rows of studs 6. The tangential rows of studs 6 are narrow paths without corrugations in order to create a substantially even surface where the studs 6 can abut. The corrugations are preferably designed as a pattern with the same spacing as the studs 6. Then it is possible to adapt the pattern to the studs 6 as create space for the studs 6 between the corrugations, see e.g. FIG. 5*a*.

Figure 3B:
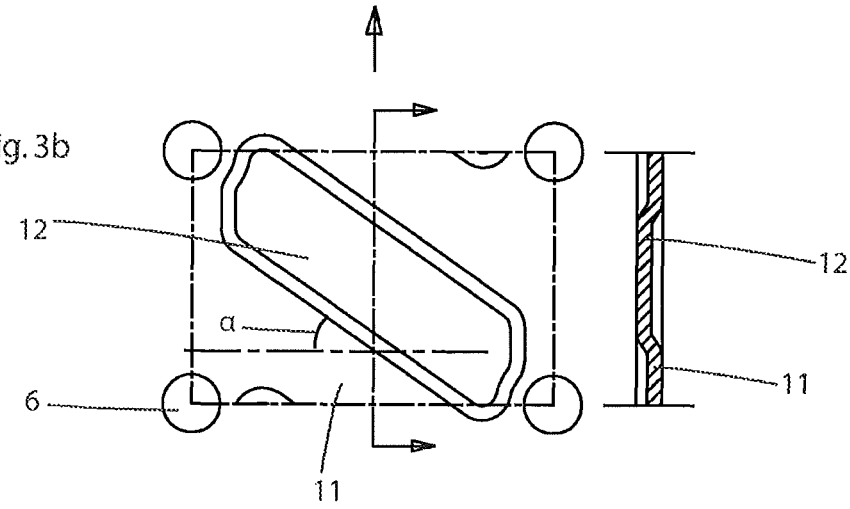
Figure 3A:
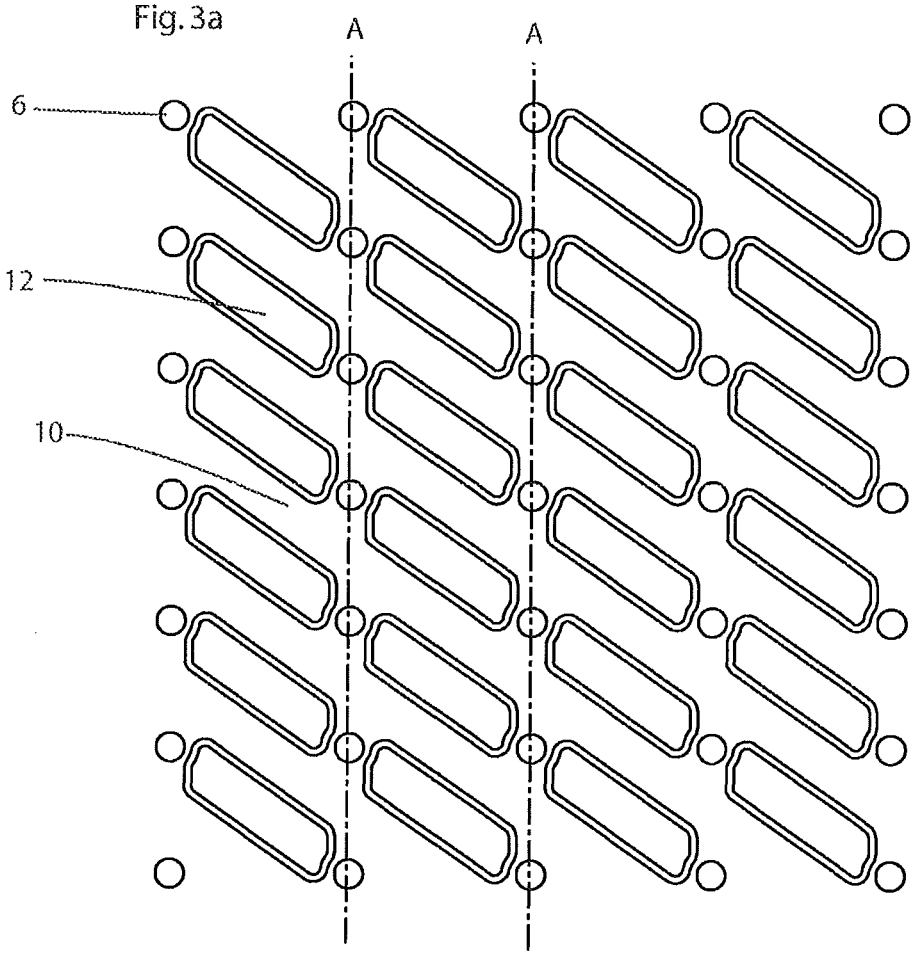

In FIG. 3*a* a heat transfer surface 10 is shown having a number of tangential rows of studs 6 with corrugations 12 arranged between the rows of studs 6. The studs 6 are formed on a substantially evenly curved surface 11 of the heat transfer surface 10 extending between the corrugations 12. The corrugations 12 are configured so that the main extension of corrugations 12 are inclined relative to the longitudinal direction A of the rows of studs 6. The inclination angle $\alpha$ of the corrugations 12 relative to the longitudinal direction A of the rows of studs 6 can be varied to achieve the most optimal heat transfer. FIG. 3*b* shows a detailed view of one corrugation 12 and the surrounding surface 11 of the closest to the corrugation 12, but also a cross sectional view of the one corrugation 12.

Figure 4B:
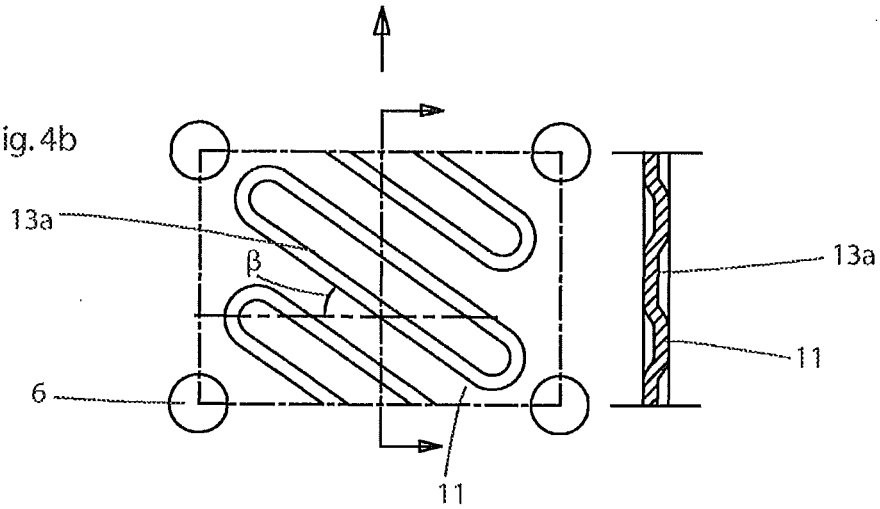
Figure 4A:
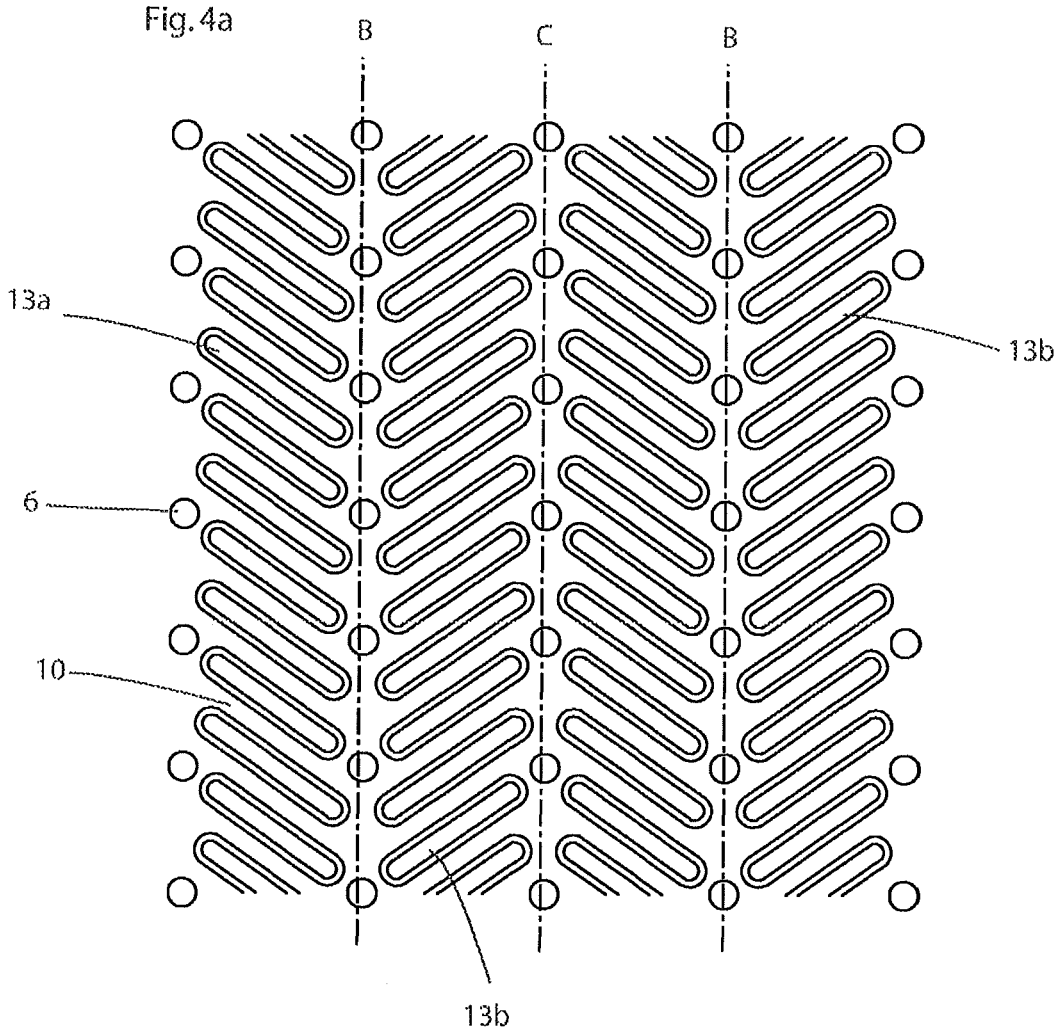

In FIG. 4*a* a heat transfer surface 10 is shown having a number of tangential rows of studs 6 with corrugations 13*a*, 13*b* arranged between the rows of studs 6. The studs 6 are formed on a substantially evenly curved surface 11 of the heat transfer surface 10 extending between the corrugations 13*a*, 13*b*. The corrugations 13*a*, 13*b* are configured so that the corrugations 13*a* between every second row of studs 6 are inclined in the same direction relative to the longitudinal directions B, C of the rows of studs 6, whereas the corrugations 13*b* therein between are inclined in an alternative direction relative to the longitudinal directions B, C of the rows of studs 6. The corrugations 13*a*, 13*b* together form a mirrored pattern in relation to the longitudinal direction B, C of the rows of studs 6, e.g. herringbone pattern or similar. The inclination angle β of the corrugations 13*a*, 13*b* relative to the longitudinal directions B, C of the rows of studs 6 can also be varied to achieve the most optimal heat transfer. FIG. 4*b* shows a detailed view of the corrugations 13*a* and the surrounding surface 11 of the closest to the corrugation 13*a*, but also a cross sectional view of the one corrugation 13*a*.

Figure 5B:
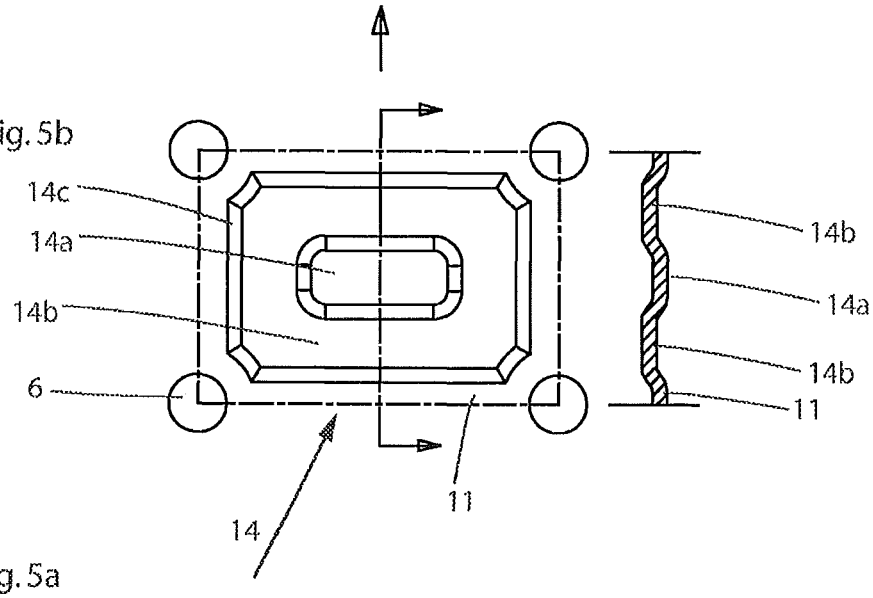
Figure 5A:
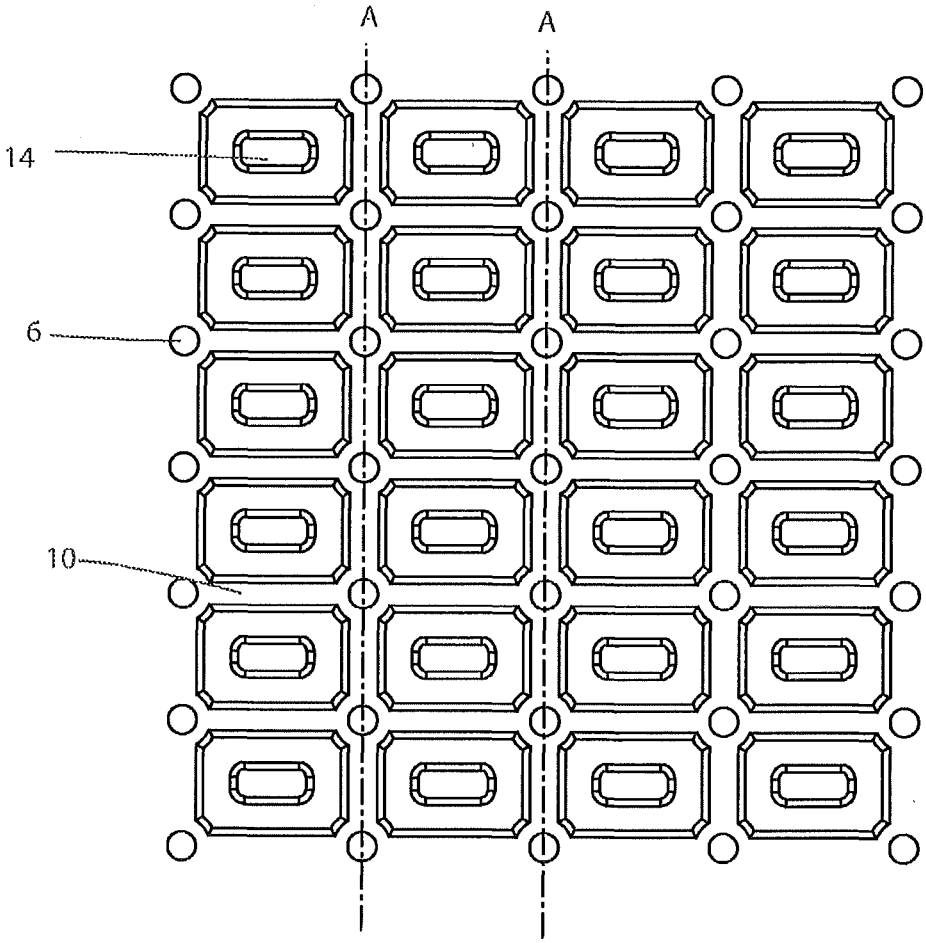

In FIG. 5*a* a heat transfer surface 10 is shown having a number of tangential rows of studs 6 with corrugations 14 arranged between the rows of studs 6. The studs 6 are formed on a substantially evenly curved surface 11 of the heat transfer surface 10 extending between the corrugations 14, where the tangential row of studs 6 extends along a longitudinal direction A. The corrugations 14 are substantially rectangular having a first surface 14*a* and a second pressed surface 14*b*. The first surface 14*a* is arranged in the centre of the corrugations 14. The second pressed surface 14*b* surrounds the first surface 14*a* like a rectangular shaped border of the corrugated 14, and is depressed relative to the surrounding surface 11 and first surface 14*a*. The pressing depth of the pressed surface 14*b* relative to the surrounding surface 11 can also be varied and the direction of the raised/ depressed surface 14*b* can be altered to optimize the heat transfer characteristics. FIG. 5*b* shows a detailed view of the surfaces 14*a*,14*b* and the surrounding surface 11 of the closest to the second pressed surface 14*b*, but also a cross sectional view of the corrugation 14.

Figure 6B:
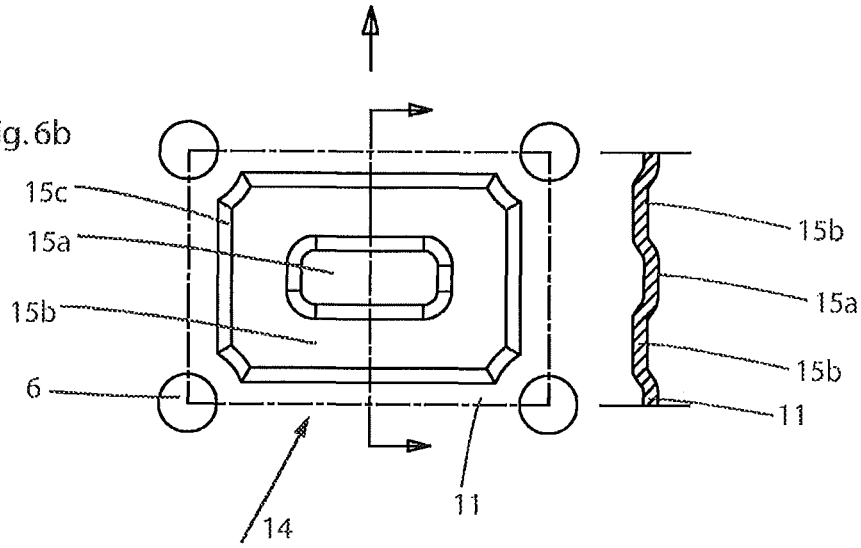
Figure 6A:
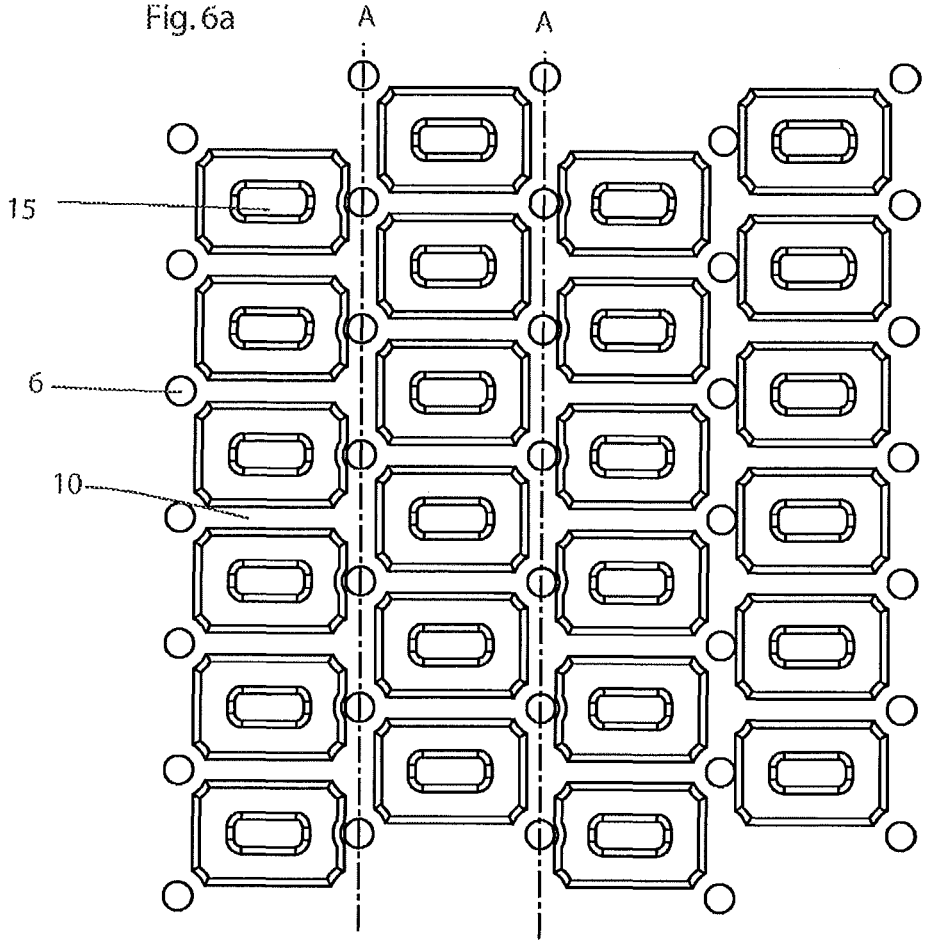

In FIG. 6*a* a heat transfer surface 10 is shown having a number of tangential rows of studs 6 with corrugations 15 arranged between the rows of studs 6. The studs 6 are formed on a substantially evenly curved surface 11 of the heat transfer surface 10 extending between the corrugations 15, where the tangential row of studs 6 extends along a longitudinal direction A. The corrugations 15 are substantially rectangular including a first surface 15*a* and a second pressed surface 15*b*. The first surface 15*a* is arranged in the centre of the corrugated 15. The second pressed surface 15*b* surrounds the first surface 15*a* like a rectangular shaped border of the corrugated 15, and is depressed relative to the surrounding surface 11 and the first surface 15*a*. The pressing depth of the pressed surfaces 15*b* relative to the surrounding surface 11 can also be varied and the direction of the raised/depressed surfaces 15*b* can be altered to optimize the heat transfer characteristics. The corrugations 15 are configured so that the corrugations 15 between every second row of studs 6 are longitudinally displaced in relation to the corrugations 15 therein between. In FIG. 6*a* the displacement of the corrugations 15 between every second row of studs 6 relative to the corrugations 15 therein between amounts to roughly a half length of the corrugation 15, but the displacement can be varied to achieve different heat transfer characteristics.

As shown in FIG. 6*a* also the studs 6 can be displaced relative to the corrugations 15 in different ways. In FIG. 6*b* is shown that the studs 6 are located in the proximity of the corners of the pressed surfaces of the corrugation 15, but it is apparent from FIG. 6*a* that other locations of the studs 6 relative to the corrugations 15 are also possible.

FIG. 6*b* shows a detailed view of the surfaces 15*a*,15*b* and the surrounding surface 11 of the closest to the second pressed surface 15*b*, but also a cross sectional view of the corrugation 15.

In FIG. 7*a* a heat transfer surface 10 is shown having a number of tangential rows of studs 6 with corrugations 16 arranged between the rows of studs 6. The studs 6 are formed on a substantially evenly curved surface 11 of the heat transfer surface 10 extending between the corrugations 16, where the tangential row of studs 6 extends along a longitudinal direction D.

The corrugations 16 are configured with a number of local corrugation surfaces 16*a* arranged on a substantially planar surface 16*b* and in between a first and second continuous corrugation, 16*c* and 16*d*, respectively. The first and second continuous corrugation 16*c*, 16*d* extends substantially in a longitudinal direction parallel to the longitudinal direction D. The local corrugation surfaces 16*a* are substantially arranged in the space between four studs 6 forming a virtual rectangle and which corrugation surfaces 16*a* being formed as a rhomb shape depressing. Other forms of the local corrugation surfaces 16*a* are also possible, like square, rectangular or circular to achieve the best heat transfer characteristics.

As shown in FIG. 7*a* the first and second continuous corrugation 16*c*, 16*d* is not a straight line, but substantially formed as a curve extending between the row of local corrugation surfaces 16*a* and the row of studs 6 with repeated recesses toward the row of local corrugation surfaces 16*a* in the vicinity of the studs 6. Other forms of the extension of the first and second continuous corrugation 16*c*, 16*d* are also possible. The first and second continuous corrugation 16*c*, 16*d* together form a mirrored pattern in relation to the longitudinal direction D of the rows of studs 6.

FIG. 7*b* shows a partial detailed view of the corrugation 16 with the local corrugation surfaces 16*a*, the substantially planar surface 16*b* and the first and second continuous corrugation, 16*c* and 16*d*. It also includes two cross sectional view of the corrugation 16.

Figure 8B:
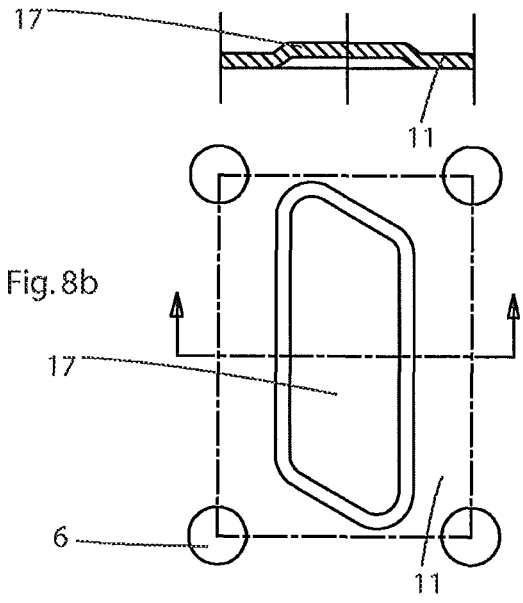
Figure 8A:
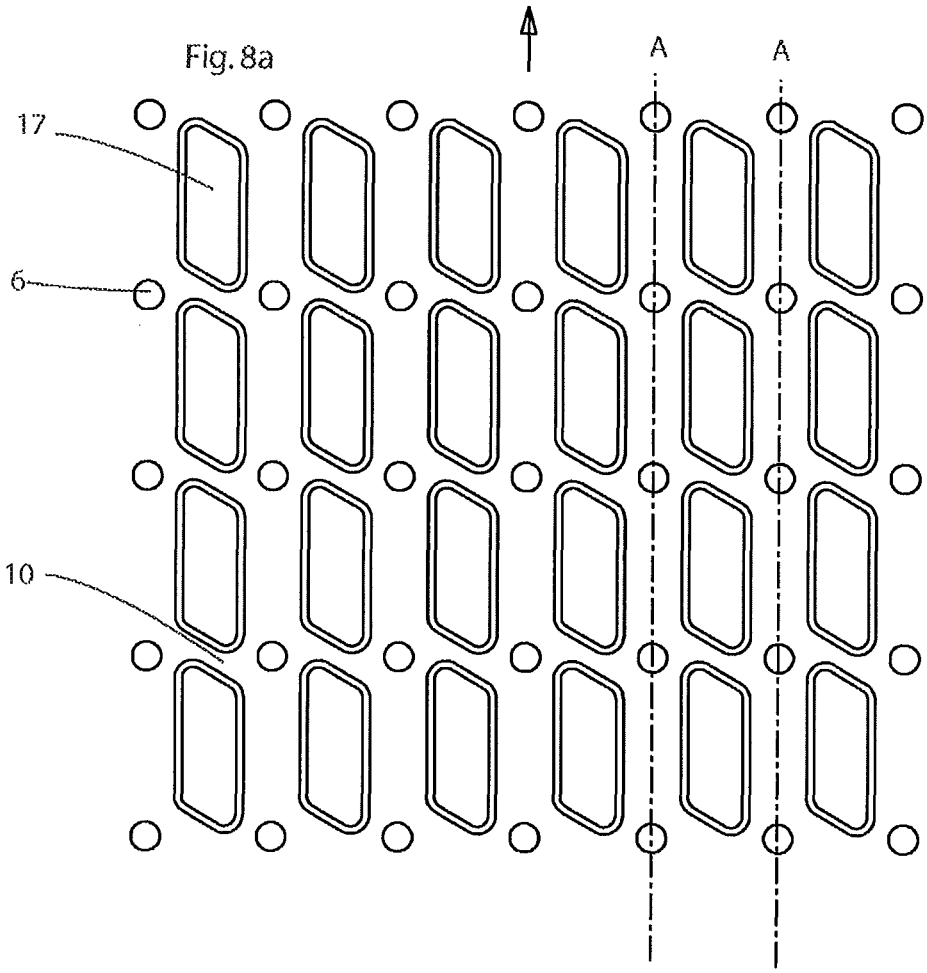

In FIG. 8*a* a heat transfer surface 10 is shown having a number of tangential rows of studs 6 with corrugations 17 arranged between the rows of studs 6. The studs 6 are formed on a substantially evenly curved surface 11 of the heat transfer surface 10 extending between the corrugations 17. The corrugations 17 are substantially configured as parallelograms having a main extension parallel to the longitudinal direction A of the rows of studs 6. FIG. 8*b* shows a detailed view of one corrugation 17 and the surrounding surface 11 of the closest to the corrugation 17, but also a cross sectional view of the one corrugation 17.

Figure 9B:
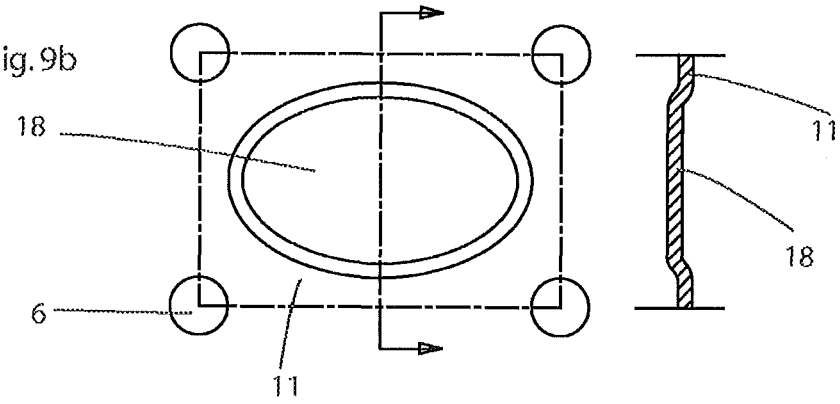
Figure 9A:
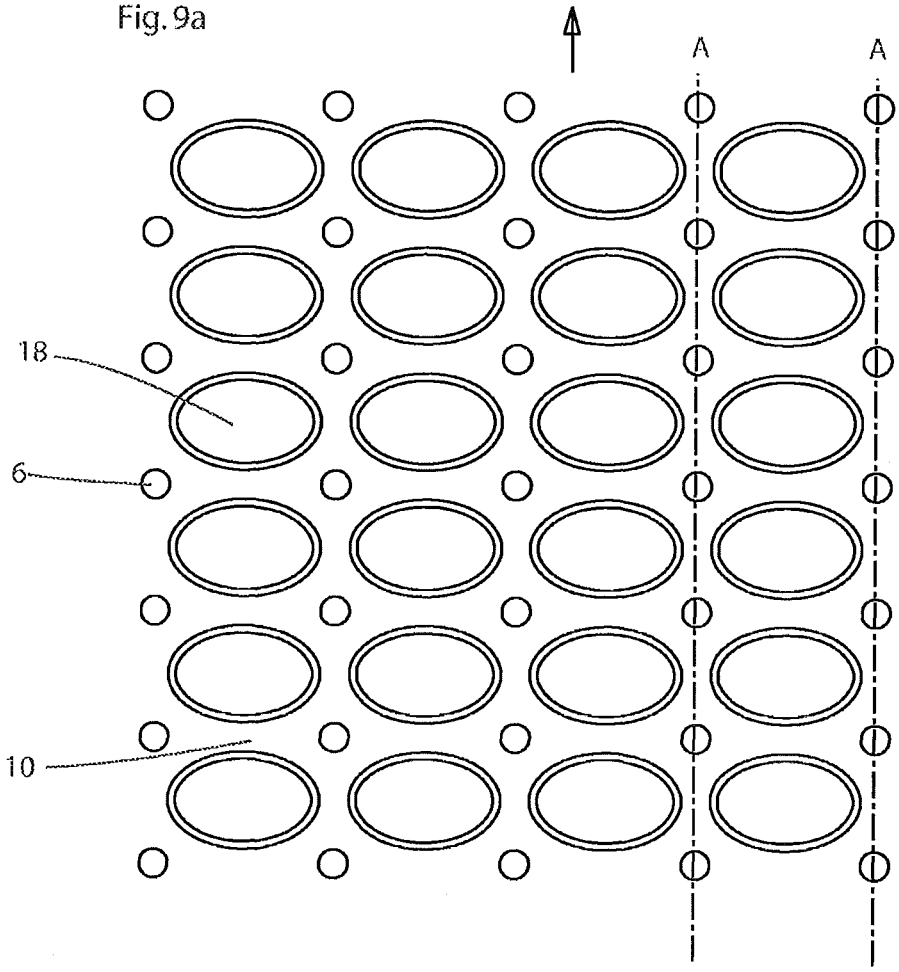

In FIG. 9*a* a heat transfer surface 10 is shown having a number of tangential rows of studs 6 with corrugations 18 arranged between the rows of studs 6. The studs 6 are formed on a substantially evenly curved surface 11 of the heat transfer surface 10 extending between the corrugations 18. The corrugations 18 are substantially configured as ovals having a main extension perpendicular to the longitudinal direction A of the rows of studs 6. FIG. 9*b* shows a detailed view of one corrugation 18 and the surrounding surface 11 of the closest to the corrugation 18, but also a cross sectional view of the corrugation 18.

Figure 10B:
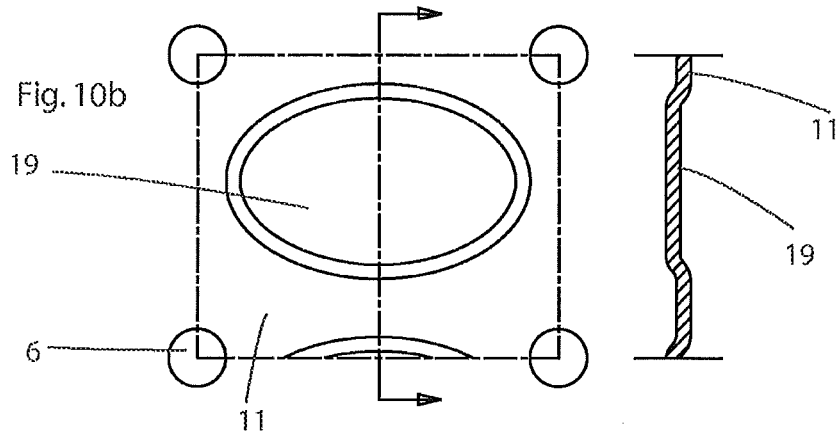
Figure 10A:
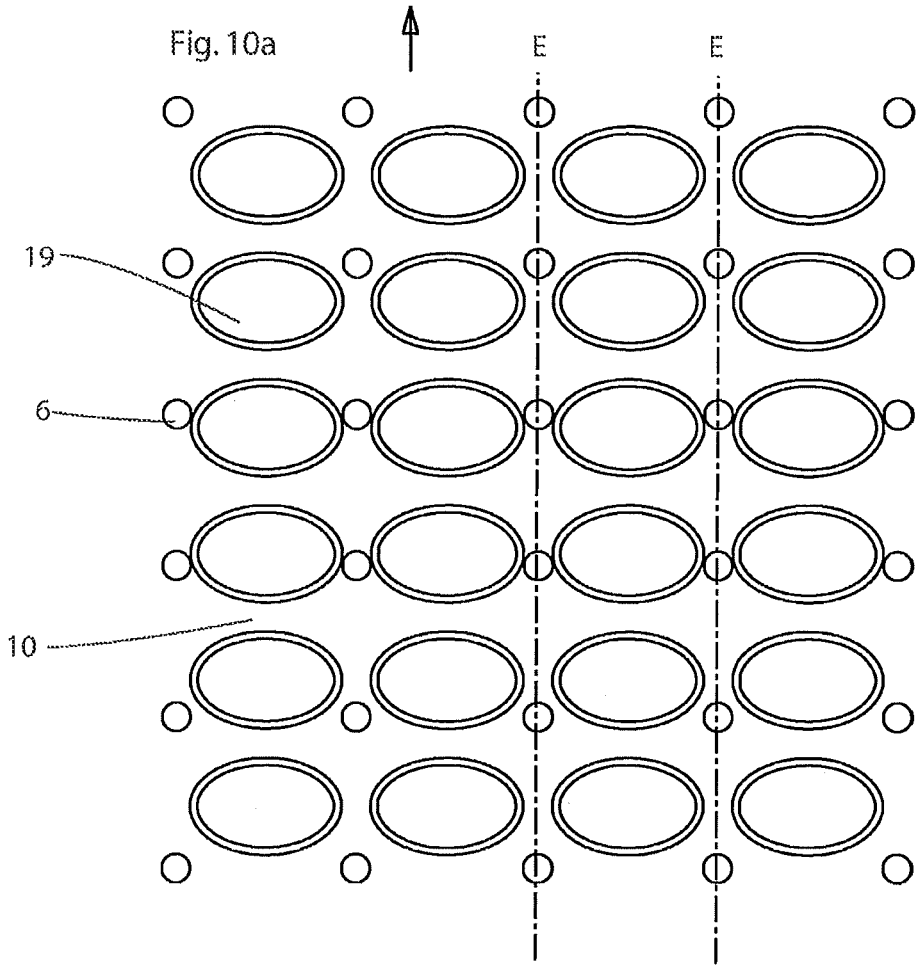

In FIG. 10*a* a heat transfer surface 10 is shown having a number of tangential rows of studs 6 with corrugations 19 arranged between the rows of studs 6. The studs 6 are formed on a substantially evenly curved surface 11 of the heat transfer surface 10 extending between the corrugations 19. The corrugations 19 are substantially configured as ovals having a main extension perpendicular to the longitudinal direction E of the rows of studs 6. FIG. 9*b* shows a detailed view of one corrugation 19 and the surrounding surface 11 of the closest to the corrugation 19, but also a cross sectional view of the corrugation 19.

The corrugations 19 of FIG. 10*a* are substantially similar to the corrugations 18 of FIG. 9*a*, but the studs 6 of FIG. 10*a* are arranged differently relative to the corrugations 19 compared how the studs 6 of FIG. 9*a* are arranged relative to the corrugations 18. In FIG. 9*a* the studs 6 are arranged with the same relative spacing between the studs 6 along the line A as the corrugations 18 so that the studs 6 are positioned symmetrically relative to the corrugations 18. In FIG. 10*a* the studs 6 are arranged with the another relative spacing between the studs 6 along the line E compared with the corrugations 19 so that the relative position of the studs 6 compared the corrugations 19 varies over the heat transfer surface 10.

Figure 11B:
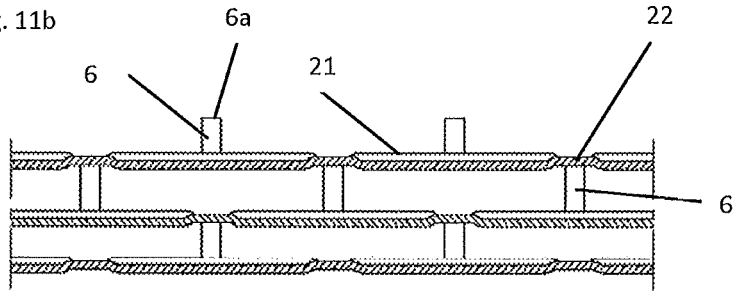
FIGS. 11*a*-11*c* are schematic views of an embodiment of the present invention having the supports arranged on the corrugation pattern.
Figure 11A:
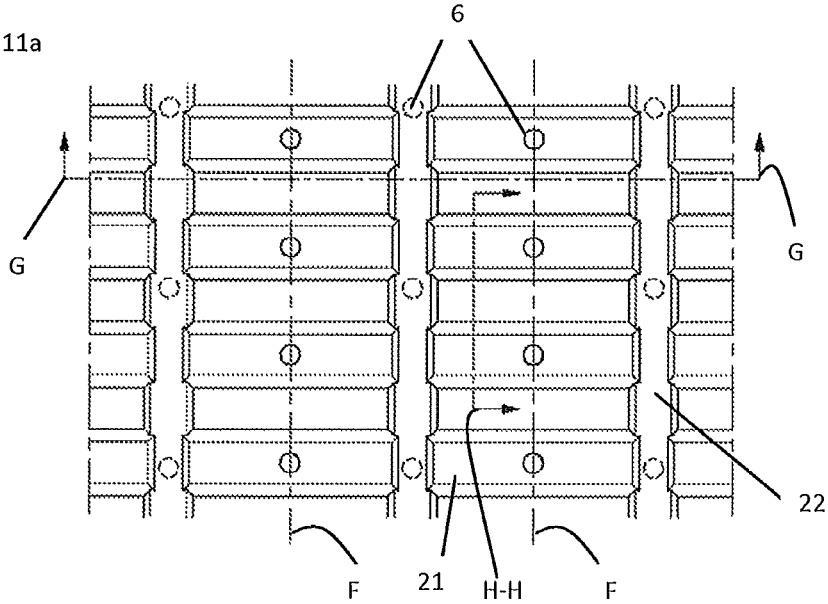
Figure 11C:
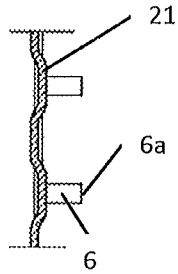

In FIG. 11*a* a heat transfer surface 11 is shown, where a number of studs 6 are arranged on corrugations 21 along a tangential centre line F of corrugations 21. In FIG. 11*b*, showing the cross-section along G-G in FIG. 11*a*, and in FIG. 11*c*, showing the cross-section along H-H in FIG. 11*a*, studs 6 welded onto the corrugations 21. In the shown embodiment of FIG. 11*a*, only one stud 6 is shown to be welded to each corrugation 21, but there can be several studs 6 welded onto each corrugation 21. Preferably the studs are arranged with equal spacing between the studs 6. The corrugations 21 are arranged with an offset of a half spacing for every second turn or wound of the spiral sheets so that the free end 6*a* of the studs 6 abuts the flat area 22 between the corrugations 21. The spacing between the studs 6 can be different in the two channels 20*a*, 20*b*. E.g. the studs in the first channel can be arranged on every corrugation, but studs in the second channel can be arranged on every second corrugation along the tangential centre line F. The two spiral sheets that form the spiral body can have different type of corrugation, but the axial spacing between the corrugations must be the same.

The gap between the corrugations is smaller than the gap between the flat areas 22. The flat areas 22 have substantially lower frictional resistance than the corrugations, which together with the bigger gap of the flat areas 22 result in a substantially lower flow resistance than in the gap between the corrugations. Thereby the flow will be much bigger in the bigger gaps between the flat areas 22 than between the corrugations, thereby lowering the pressure drop. Thus, the heat transfer also will be lower. By arranging the studs 6 with small distance between each stud 6 along the tangential centre line F of corrugations 21 the studs 6 creates a resistance, which to some degree neutralize the friction reduction. But if the studs 6 are arranged with a greater distance between each stud 6 it results in a by-pass effect.

The strength of the spiral sheet is also improved by having studs arranged on with the free end abutting the flat areas 22.

The pressing depth of the corrugations or corrugation surfaces in the above shown embodiments of FIGS. 3*a*-11*a* relative to the surrounding surface 11 or between different corrugation surfaces can also be varied to optimize the heat transfer characteristics.

FIGS. 3-11 show seven different patterns of the heat transfer surface, but other possible patterns are also possible within the scope of the invention.

The functionality of the spiral heat exchanger 1 is as follows: A first medium enters the spiral heat exchanger 1 through the first connection element 8*a* formed as an inlet and where first connection element 8*a* is connected to a piping arrangement. The first connection element 8*a* communicates with a first flow channel of the spiral body 2 and the first medium is transported through the first flow channel to the second connection element 9*b* formed as an outlet, where the first medium leaves the spiral heat exchanger 1. The second connection element 9*b* is connected to a piping arrangement for further transportation of the first medium.

A second medium enters spiral heat exchanger 1 through the second connection element 9*a* formed as an inlet, the second connection element 9*a* being connected to a piping arrangement. The second connection element 9*a* communicates with a second flow channel of the spiral body 2 and the second medium is transported through the second flow channel to the first connection element 8*b* formed as an outlet, where the second medium leaves the spiral heat exchanger 1. The first connection element 8*b* is connected to a piping arrangement for further transportation of the second medium.

Inside the spiral body 2 a heat exchange will occur between the first and second medium, so that one medium is heated and the other medium is cooled. Depending on the specific use of the spiral heat exchanger 1 the selection of the two mediums will vary. In the above it has been described as the two mediums circulate in opposite directions through the spiral heat exchanger, but it is apparent that they may also circulate parallel directions.

In the above description the term connecting element has been used as an element connected to spiral heat exchanger and more specifically to the flow channels of the spiral heat exchanger, but it should be understood that the connecting element is a connection pipe or similar that typically are welded onto the spiral heat exchanger and may include means for connecting further piping arrangements to the connecting element.

Tests have shown that the corrugations of the heat transfer surface not only improve the heat transfer, but that a material saving can be obtained if the heat transfer surface of a spiral heat exchanger is corrugated. This is due to improved mechanical strength, improved thermal performance and better utilization of the material. It is also important to consider that a spiral heat exchanger has a smooth self-cleaning flow channel with low pressure drop. This is an advantage compared with other heat exchangers. The pattern or corrugation of the spiral heat exchanger must therefore be adapted to the spiral heat exchanger characteristics. It should not be designed according to normal plate heat exchanger practice.

The pattern of the heat transfer surface with a similar pattern for both the corrugations and the studs gives an increased mechanical strength, and it creates also an efficient turbulence that improves the thermal performance.

In the description the term corrugated or corrugations have been used to define a surface having areas of the surface which is raised and/or depressed compared with the surrounding areas. The corrugated surface can be isolated spots or fields, wherein between the surfaces are substantially even. In the embodiments shown in Figures it might appear as the extension of the sheet of the spiral heat exchanger is substantially planar or even, but it obvious that the sheets and the surfaces and corrugations formed thereon are curved to form the spiral.

In the above description the supports and the corrugation have been shown in various combinations. It is obvious that other combinations are also possible with different direction and forms of the corrugations and the location of the supports relative to the corrugations within the scope of the invention.

The invention is not limited to the embodiments described above and shown on the drawings, but can be supplemented and modified in any manner within the scope of the invention as defined by the enclosed claims.

The invention claimed is:

1. A spiral heat exchanger including a spiral body formed by at least one spiral sheet wounded to form the spiral body forming at least a first spiral-shaped flow channel for a first medium and a second spiral-shaped flow channel for a second medium, wherein the spiral body is enclosed by a substantially cylindrical shell being provided with connecting elements communicating with the first flow channel and the second flow channel where the at least one spiral sheet comprises a corrugated heat transfer surface with corrugations for increasing the heat transfer and supports for spacing the wounds of the at least one spiral sheet in the spiral body, the supports are studs welded onto the at least one spiral sheet and are provided on tangential paths on the at least one spiral sheet between the corrugations and where the tangential paths between the corrugations are substantially evenly curved surfaces.

2. A spiral heat exchanger according to claim 1, wherein the main extensions of corrugations are inclined with an angle relative a longitudinal direction parallel to the tangential paths of the supports.

3. A spiral heat exchanger according to claim 1, wherein the corrugated heat transfer surface of the spiral heat exchanger includes at least one type of the corrugations.

4. A spiral heat exchanger according to claim 3, wherein the corrugated heat transfer surface of the spiral heat exchanger includes two types of corrugations and where the two types of corrugations together forms a mirror shaped corrugation pattern relative to the tangential paths of supports.

5. A spiral heat exchanger according to claim 3, wherein the corrugations includes different corrugated surfaces within the corrugations.

6. A spiral heat exchanger according to claim 5, wherein the different corrugated surfaces within the corrugations have different pressing depth.

7. A spiral heat exchanger according to claim 1, wherein the relative spacing between the supports along a longitudinal direction and between the corrugations along a longitudinal direction parallel to the longitudinal direction are substantially the same.

8. A spiral heat exchanger according to claim 1, wherein the relative spacing between the supports a longitudinal direction and between the corrugations and between the corrugations along a longitudinal direction parallel to the longitudinal direction are substantially different.

* * * * *